US009016814B2

(12) United States Patent
Shimada et al.

(10) Patent No.: US 9,016,814 B2
(45) Date of Patent: Apr. 28, 2015

(54) IMAGE RECORDING APPARATUS AND IMAGE RECORDING METHOD

(75) Inventors: Yoshitaka Shimada, Matsumoto (JP); Shinichi Kamoshida, Saitama (JP); Mitsuaki Yoshizawa, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 283 days.

(21) Appl. No.: 13/463,382

(22) Filed: May 3, 2012

(65) Prior Publication Data

US 2012/0293575 A1 Nov. 22, 2012

(30) Foreign Application Priority Data

May 20, 2011 (JP) ..... 2011-113916

(51) Int. Cl.
*B41J 29/38* (2006.01)
*B41J 11/00* (2006.01)

(52) U.S. Cl.
CPC ..... *B41J 11/002* (2013.01)
USPC ..... 347/9

(58) Field of Classification Search
CPC .. B41J 2/04541; B41J 2/0458; B41J 2/04581; B41J 2/04588; B41J 2/04543
USPC ..... 347/9
See application file for complete search history.

(56) References Cited

U.S. PATENT DOCUMENTS

| | | | | |
|---|---|---|---|---|
| 6,318,915 | B1 | 11/2001 | Matsuoka | |
| 2003/0035037 | A1 * | 2/2003 | Mills et al. | 347/102 |
| 2006/0012630 | A1 * | 1/2006 | Niekawa | 347/37 |
| 2011/0074857 | A1 | 3/2011 | Mitsuzawa | |

FOREIGN PATENT DOCUMENTS

| | | |
|---|---|---|
| JP | 2000-001015 | 1/2000 |
| JP | 2004-338303 | 12/2004 |
| JP | 2005-041028 | 2/2005 |
| JP | 2005-254560 A | 9/2005 |
| JP | 2006-026970 A | 2/2006 |
| JP | 2006-110840 | 4/2006 |
| JP | 2009-154409 | 7/2009 |
| JP | 2010-125674 | 6/2010 |
| JP | 2010-149400 | 7/2010 |
| JP | 2011-073330 | 4/2011 |

* cited by examiner

*Primary Examiner* — Manish S Shah
*Assistant Examiner* — Yaovi Ameh
(74) *Attorney, Agent, or Firm* — Workman Nydegger

(57) ABSTRACT

An image recording apparatus causes the repeated alternating execution of an ejection operation, in which light-curable ink is ejected from a head while the head and a light irradiation unit are moved in a predetermined direction by a movement mechanism, and a transport operation, in which a medium is moved relative to the head and the light irradiation unit in a direction that is orthogonal to the predetermined direction; and reduces the irradiation intensity of the light irradiation unit during acceleration/deceleration periods, when the movement mechanism moves the head and the light irradiation unit at a velocity that is lower than a predetermined velocity, to a lower irradiation intensity than the irradiation intensity of the light irradiation unit during a constant velocity period, when the movement mechanism moves the head and the light irradiation unit at the predetermined velocity.

6 Claims, 7 Drawing Sheets

IMAGE RECORDING APPARATUS AND IMAGE RECORDING METHOD

The entire disclosure of Japanese Patent Application No: 2011-113916, filed May 20, 2011 is expressly incorporated by reference herein in its entirety.

BACKGROUND

1. Technical Field

The present invention relates to image recording apparatuses and image recording methods.

2. Related Art

There are printers, which are examples of image recording apparatuses, that eject UV ink cured through irradiation with ultraviolet light (light-curable ink) onto a medium. In addition, there are printers, provided with ultraviolet light irradiation light sources on both sides of a head, in which the irradiation light sources move along with the head, which ejects UV ink while moving in a predetermined direction (for example, see JP-A-2005-254560). With such a printer, it is possible to immediately cure the UV ink that has landed upon the medium.

Meanwhile, there are cases where, for example, the distance that the head moves is adjusted in accordance with the width of the image to be printed in order to reduce the printing time. In such a case, the irradiation light sources will be positioned opposite to the medium during acceleration/deceleration periods in which the head moves at a velocity that is lower than a predetermined velocity. The time for which the irradiation light sources are positioned opposite to the medium is thus longer during the acceleration/deceleration periods than during a constant velocity period, in which the head moves at the predetermined velocity. If such is the case, the medium will, for example, extend or shrink due to the heat from the irradiation light sources.

SUMMARY

It is an advantage of some aspects of the invention to suppress negative influence on a medium by a light irradiation unit.

An image recording apparatus according to an aspect of the invention includes: a head that ejects light-curable ink onto a medium; a light irradiation unit that cures the light-curable ink on the medium by irradiating the light-curable ink with light; a movement mechanism that moves the head and the light irradiation unit in a predetermined direction relative to the medium; and a control unit that causes the repeated alternating execution of an ejection operation, in which the light-curable ink is ejected from the head while the head and the light irradiation unit are moved in the predetermined direction by the movement mechanism, and a transport operation, in which the medium is moved relative to the head and the light irradiation unit in a direction that is orthogonal to the predetermined direction. Here, the control unit reduces the irradiation intensity of the light irradiation unit during acceleration/deceleration periods, in which the movement mechanism moves the head and the light irradiation unit at a movement velocity that is slower than a predetermined velocity, to be lower than the irradiation intensity of the light irradiation unit during a constant velocity period, in which the movement mechanism moves the head and the light irradiation unit at the predetermined velocity.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

FIG. 5A is a diagram illustrating a relationship between an irradiation intensity of a pre-irradiation unit, a carriage velocity, and a medium and an image according to a first working example, whereas

FIG. 6A is a diagram illustrating a relationship between an irradiation intensity of a pre-irradiation unit and a carriage velocity according to a second working example, whereas

DESCRIPTION OF EXEMPLARY EMBODIMENTS

Overview of the Invention

Figure 1:
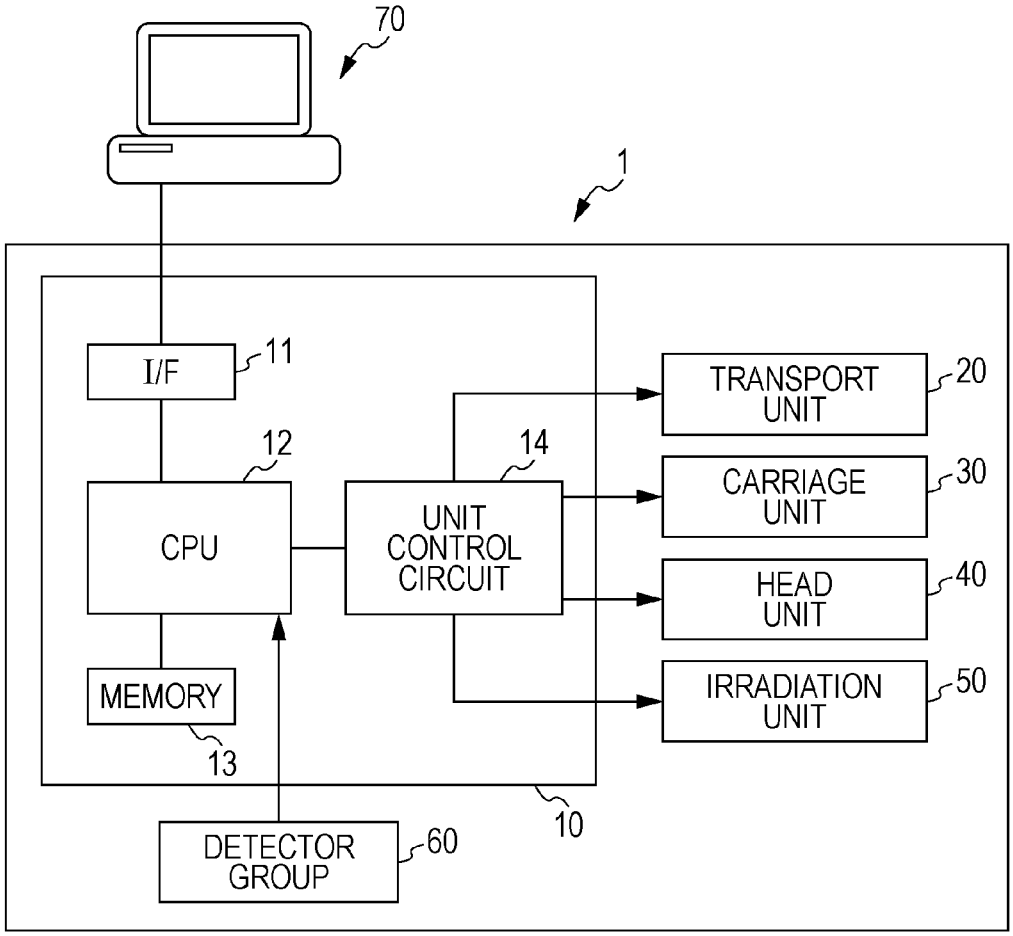
FIG. 1 is a block diagram illustrating the overall configuration of a printer.

At least the following will be made clear through the descriptions in this specification and the content of the appended drawings.

In other words, an image recording apparatus according to the invention includes: a head that ejects light-curable ink onto a medium; a light irradiation unit that cures the light-curable ink on the medium by irradiating the light-curable ink with light; a movement mechanism that moves the head and the light irradiation unit in a predetermined direction relative to the medium; and a control unit that causes the repeated alternating execution of an ejection operation, in which the light-curable ink is ejected from the head while the head and the light irradiation unit are moved in the predetermined direction by the movement mechanism, and a transport operation, in which the medium is moved relative to the head and the light irradiation unit in a direction that is orthogonal to the predetermined direction. Here, the control unit reduces the irradiation intensity of the light irradiation unit during acceleration/deceleration periods, in which the movement mechanism moves the head and the light irradiation unit at a movement velocity that is slower than a predetermined velocity, to be lower than the irradiation intensity of the light irradiation unit during a constant velocity period, in which the movement mechanism moves the head and the light irradiation unit at the predetermined velocity.

According to this image recording apparatus, negative influence on the medium (for example, extension/shrinkage due to heat) from the light irradiation unit can be prevented even if the time for which the light irradiation unit and the medium are opposed is longer during the acceleration/deceleration periods than during the constant velocity period.

In the image recording apparatus, it is preferable that the control unit adjust the amount the movement mechanism moves the head and the light irradiation unit in the predetermined direction in accordance with the location, in the predetermined direction, of an end of an image recorded on the medium.

According to this image recording apparatus, the image recording time can be reduced while suppressing negative influence on the medium from the light irradiation unit.

In the image recording apparatus, it is preferable that the control unit stop the irradiation of light from the light irradiation unit during a period in which the movement of the head and the light irradiation unit in the predetermined direction by the movement mechanism is stopped in a state in which the light irradiation unit and the medium are opposed to each other.

According to this image recording apparatus, negative influence on the medium from the light irradiation unit can be prevented with more certainty.

In the image recording apparatus, it is preferable that the control unit stop the movement of the head and the light irradiation unit in the predetermined direction by the movement mechanism in a state in which the a light irradiation surface of the light irradiation unit is opposed to the light-curable ink on the medium.

According to this image recording apparatus, negative influence on the medium from the light irradiation unit can be prevented with more certainty.

In the image recording apparatus, it is preferable that during the acceleration/deceleration periods, the control unit reduce the irradiation intensity of the light irradiation unit when the movement mechanism moves the head and the light irradiation unit at a second velocity that is slower than a first velocity, to be lower than the irradiation intensity of the light irradiation unit when the movement mechanism moves the head and the light irradiation unit at the first velocity.

According to this image recording apparatus, images can be cured with certainty.

An image recording method according to the invention, meanwhile, is a method for recording an image onto a medium using an image recording apparatus that includes: a head that ejects light-curable ink onto a medium; a light irradiation unit that cures the light-curable ink on the medium by irradiating the light-curable ink with light; a movement mechanism that moves the head and the light irradiation unit in a predetermined direction relative to the medium; and a control unit that causes the repeated alternating execution of an ejection operation, in which the light-curable ink is ejected from the head while the head and the light irradiation unit are moved in the predetermined direction by the movement mechanism, and a transport operation, in which the medium is moved relative to the head and the light irradiation unit in a direction that is orthogonal to the predetermined direction. Here, the control unit reduces the irradiation intensity of the light irradiation unit during acceleration/deceleration periods, in which the movement mechanism moves the head and the light irradiation unit at a movement velocity that is slower than a predetermined velocity, to be lower than the irradiation intensity of the light irradiation unit during a constant velocity period, in which the movement mechanism moves the head and the light irradiation unit at the predetermined velocity.

According to this image recording method, negative influence on the medium (for example, extension/shrinkage due to heat) from the light irradiation unit can be prevented even if the time for which the light irradiation unit and the medium are opposed is longer during the acceleration/deceleration periods than during the constant velocity period.

Printing System

An embodiment will now be described using, as an example, a printing system in which an ink jet printer (called a "printer" hereinafter) and a computer are connected, where the printer serves as an image recording apparatus.

Figure 2A:
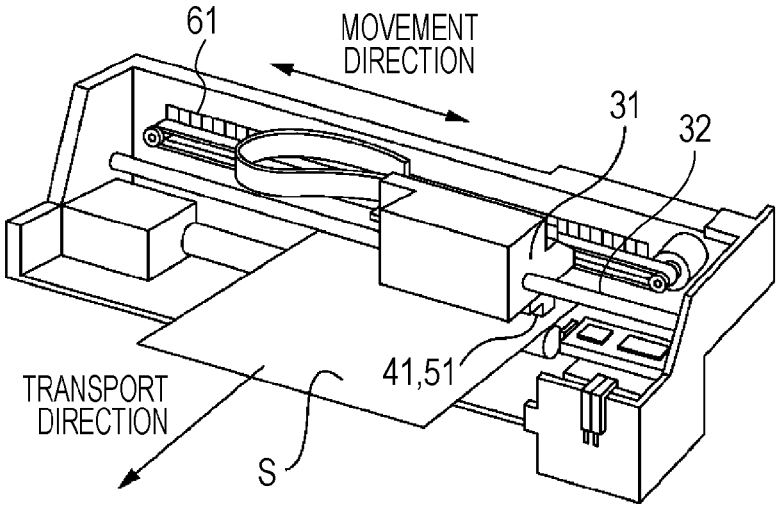
FIG. 2A is a schematic perspective view illustrating the printer.
Figure 2B:
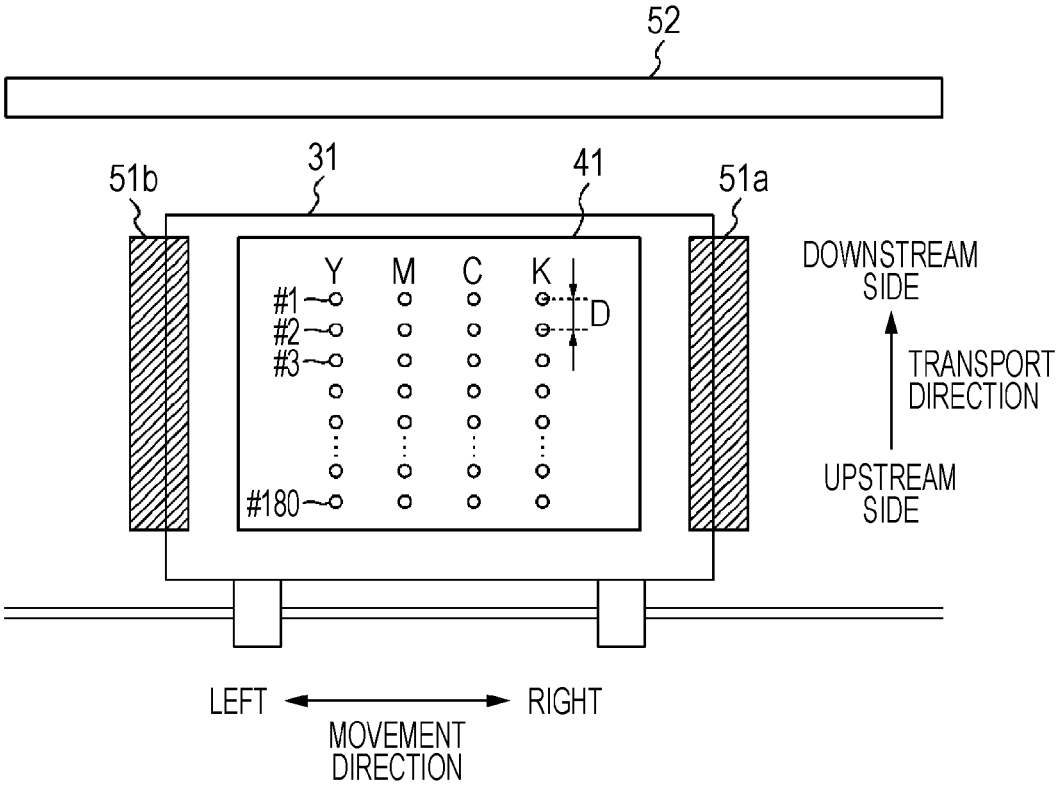
FIG. 2B is a diagram illustrating the vicinity of a carriage.

FIG. 1 is a block diagram illustrating the overall configuration of a printer 1; FIG. 2A is a schematic perspective view illustrating the printer 1; and FIG. 2B is a diagram illustrating the vicinity of a carriage 31. Note that FIG. 2B illustrates nozzle arrays virtually, as seen from above a head 41.

The printer 1 according to this embodiment prints images onto a medium S (examples: paper, cloth, film) by ejecting ultraviolet light-curable ink that is cured through irradiation with ultraviolet light (this corresponds to "light-curable ink"). Note that the ultraviolet light-curable ink (called "UV ink" hereinafter) is an ink that includes an ultraviolet light-curable resin, and is cured through a photopolymerization reaction that occurs in the ultraviolet light-curable resin when the resin is irradiated with ultraviolet light.

A computer 70 is connected to the printer 1 in a communicable state, and outputs, to the printer 1, print data for causing the printer 1 to print images.

A controller 10 is a control unit for controlling the printer 1. An interface unit 11 is a unit used for exchanging data between the computer 70 and the printer 1. A CPU 12 is a computational processing device for carrying out the overall control of the printer 1. A memory 13 is a unit for securing a region for storing programs executed by the CPU 12, a work region, and so on. The CPU 12 controls the various units in accordance with a unit control circuit 14. Note that a detector group 60 monitors conditions within the printer 1, and the controller 10 controls the various units based on detection results from the detector group 60.

A transport unit 20 feeds the medium S to a location where printing can be carried out, and transports the medium S in a transport direction by a predetermined transport amount during printing.

A carriage unit 30 (this corresponds to a "movement mechanism") is a unit that moves the head 41, pre-irradiation units 51, and so on mounted on the carriage 31 along a guide rail 32, in a movement direction that is orthogonal to the transport direction.

A head unit 40 is a unit for ejecting ink onto the medium S, and includes the head 41. As shown in FIG. 2B, a plurality of nozzle rows, in each of which nozzles (#1 through #180) that eject ink are arranged at predetermined intervals (a nozzle pitch D) in the transport direction, are formed in the bottom surface of the head 41. The printer 1 according to this embodiment is capable of ejecting four colors of ink (YMCK), and therefore a yellow nozzle row Y that ejects yellow ink, a magenta nozzle row M that ejects magenta ink, a cyan nozzle row C that ejects cyan ink, and a black nozzle row K that ejects black ink are formed in the head 41.

Note that the nozzles communicate with ink chambers that are filled with ink, and the technique used to eject the ink from the nozzles may be a piezoelectric technique in which a voltage is applied to driving elements (piezoelectric elements) in order to cause the ink chambers to expand and contract, ejecting the ink from the nozzles as a result, or may be a thermal technique in which bubbles are produced within the nozzles using thermal elements and the ink is ejected from the nozzles due to the bubbles.

An irradiation unit 50 is a unit for curing the UV ink upon the medium by irradiating the UV ink with ultraviolet light, and includes pre-irradiation units 51 and a main irradiation unit 52. For example, light emitting diodes (LEDs), metal halide lamps, mercury lamps, or the like can be given as examples of light sources used to irradiate the ultraviolet light. Meanwhile, the amount of ultraviolet light irradiated by the pre-irradiation units 51 and the main irradiation unit 52 per unit of surface area (that is, the irradiation energy (mJ/$cm^2$)) is determined by the product of the ultraviolet light irradiation intensity (mW/$cm^2$) and the irradiation time (s).

Pre-irradiation units 51*a* and 51*b* (these correspond to a "light irradiation unit") are, as shown in FIG. 2B, disposed on both ends of the carriage 31 in the movement direction thereof, and move in the movement direction along with the head 41 as a result of the movement of the carriage 31. Note that the pre-irradiation units 51*a* and 51*b* are arranged along the movement direction in the same manner as the nozzle rows (YMCK) formed in the head 41, and like the nozzle rows, extend in the transport direction. Accordingly, the UV ink ejected from the head 41 during movement in the movement direction is irradiated with ultraviolet light by the pre-irradiation units 51*a* and 51*b* immediately after landing upon the medium S.

When the carriage 31 is on an outbound pass, in which the carriage 31 moves to the left in the movement direction, the UV ink ejected from the head 41 is irradiated with ultraviolet light by the first pre-irradiation unit 51*a*, which is located on the right side in the movement direction. Conversely, when the carriage 31 is on an inbound pass, in which the carriage 32 moves to the right in the movement direction, the UV ink ejected from the head 41 is irradiated with ultraviolet light by the second pre-irradiation unit 51*b*, which is located on the left side in the movement direction.

The main irradiation unit 52 is anchored downstream in the transport direction from the carriage 31. The length of the main irradiation unit 52 in the movement direction is greater than or equal to the length of the medium S in the movement direction, and the UV ink on the medium S is completely cured by the main irradiation unit 52 irradiating the UV ink upon the medium S with ultraviolet light.

With this printer 1, the controller 10 (this corresponds to a "control unit") causes the repeated alternating execution of an ejection operation, in which the ink is ejected from the head 41 while the head 41 and the pre-irradiation units 51 are moved in the movement direction by the carriage 31, and a transport operation, in which the medium is moved in the transport direction relative to the head 41 and the pre-irradiation units 51. As a result, the dots formed by later ejection operations are formed in locations on the medium S that differ from the locations in which dots are formed by earlier ejection operations, and thus a two-dimensional image is printed (recorded) on the medium S. In the following descriptions, a single ejection operation will be referred to as a "pass".

Carriage Velocity Vc

The printer 1 according to this embodiment uses a linear encoder to detect the velocity at which the carriage 31, in which the head 41 and the pre-irradiation units 51 are mounted, moves in the movement direction (called a "carriage velocity Vc" hereinafter). The linear encoder is an element for detecting the position of the carriage 31 in the movement direction, and includes a linear scale 61 (see FIG. 2A) and a detection unit (not shown) provided on the rear surface of the carriage 31 so as to oppose the linear scale 61.

A time T spanning from when the detection unit detects a given slit in the linear scale 61 to when the detection unit detects the next slit corresponds to the time required for the carriage 31 to move by a slit interval λ (example: 180 dpi) in the movement direction. Accordingly, by dividing the slit interval λ by the time T in which the detection unit detects the slits, the carriage velocity Vc (=λ/T) can be found.

Figure 3:
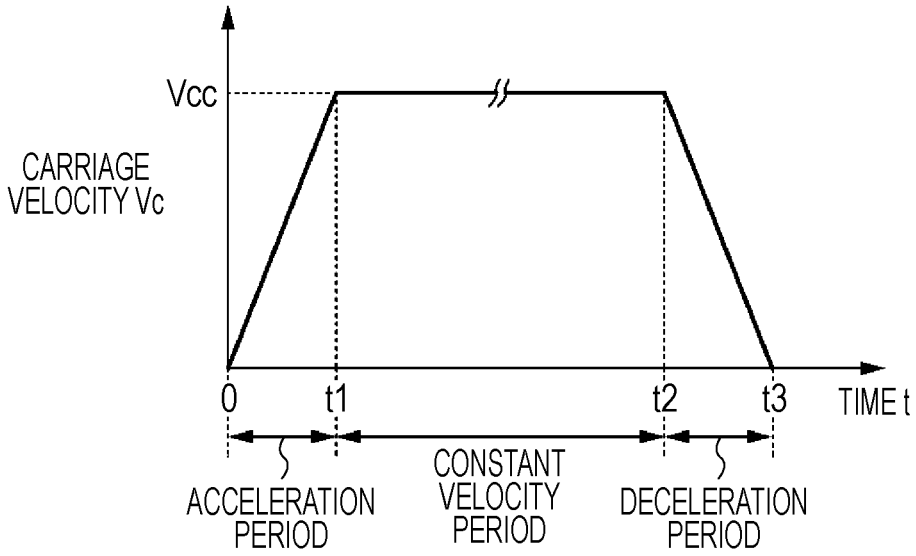
FIG. 3 is a diagram illustrating changes in the velocity of the carriage.

FIG. 3 is a diagram illustrating changes in the carriage velocity Vc. The horizontal axis represents time t, whereas the vertical axis represents the carriage velocity Vc. The controller 10 carries out control that gradually increases the carriage velocity Vc from a state in which the carriage 31 is stopped and moves the carriage 31 at a prescribed constant velocity Vcc when the carriage velocity Vc has reached the velocity Vcc. The controller 10 then gradually reduces the carriage velocity Vc from the state in which the carriage 31 is moving at the constant velocity Vcc, and stops the carriage 31.

In this manner, an acceleration period (0 to t1), a constant velocity period (t1 to t2), and a deceleration period (t2 to t3) are present in the period in which the carriage 31 moves once in the movement direction (that is, in a single pass). Although the carriage 31 moves at the constant velocity Vcc during the constant velocity period, the carriage 31 moves at a lower velocity than the constant velocity Vcc during the acceleration period and the deceleration period (that is, during the acceleration/deceleration periods).

Printer According to Comparative Example

Figure 4A:
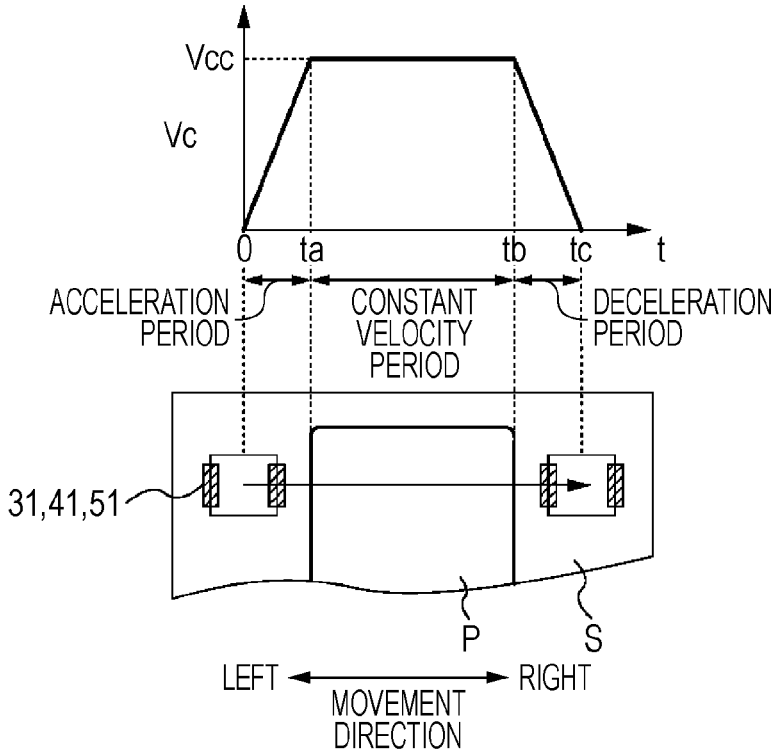
FIG. 4A and FIG. 4B are diagrams illustrating carriage velocities and positional relationships between a medium and an image in a printer according to a comparative example.
Figure 4B:
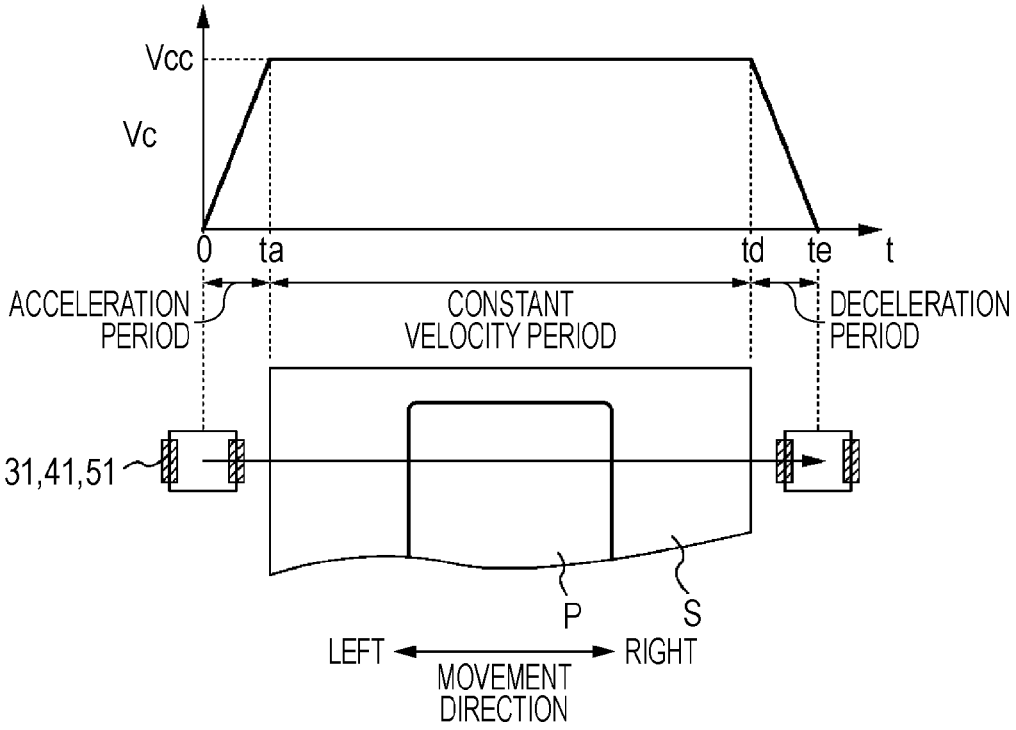

FIGS. 4A and 4B are diagrams illustrating the carriage velocity Vc and a positional relationship between the medium S and an image P in a printer according to a comparative example. Note that here, it is assumed that the image P is printed only during the constant velocity period, when the carriage velocity Vc is the constant velocity Vcc, and the image P is not printed during the acceleration/deceleration periods, when the carriage velocity Vc is not the constant velocity Vcc. Furthermore, it is assumed that the irradiation intensity of the pre-irradiation units 51 is always constant, in both the acceleration/deceleration periods and the constant velocity period.

In the case where the width (length in the movement direction) of the medium S is shorter than the width (length in the movement direction) of the image P, when the carriage 31 is moved from the left end to the right end of the guide rail 32 (a home position), the carriage 31 is undergoing unnecessary movement, which causes a wasteful increase in the printing time.

Accordingly, the printer according to the comparative example shown in FIG. 4A adjusts the movement distance of the carriage 31 in accordance with the position of the ends of the image P in the movement direction. For example, the carriage 31 begins moving from a point to the left of the left end of the image P that corresponds to the distance by which the carriage 31 moves during the acceleration period, and the carriage 31 stops moving at a point to the right of the right end of the image P that corresponds to the distance by which the carriage 31 moves during the deceleration period. Doing so makes it possible to reduce the printing time, as compared to the case where the carriage 31 moves from the left end to the right end of the guide rail 32.

However, in this case, the pre-irradiation units 51 mounted in the carriage 31 oppose the medium S during the acceleration/deceleration periods, the stopped period of the carriage 31, and so on. The carriage velocity Vc is lower in the acceleration/deceleration periods than in the constant velocity period. Accordingly, the medium is opposed to the pre-irradiation units 51 for a longer time in the areas where the medium is opposed to the pre-irradiation units 51 during the acceleration/deceleration periods than the areas where the medium is opposed to the pre-irradiation units 51 during the constant velocity period. When the pre-irradiation units 51 and the medium S are opposed for a long period of time, the amount of heat emitted toward the medium S from the pre-irradiation units 51 (light source) increases, which causes the medium S to extend/shrink, and the amount of ultraviolet light (the irradiation energy) irradiated toward the medium S from the pre-irradiation units 51 increases, which causes the medium S to degrade. This causes a drop in the quality of the printed image.

Meanwhile, preparation for the next pass, operations for transporting the medium S, and so on are carried out during the period when the carriage 31 is stopped. Accordingly, the medium is opposed to the pre-irradiation units 51 for even longer time at areas where the medium is opposed to the pre-irradiation units 51 during the stopped period of the carriage 31, which makes it easier for the medium S to extend/shrink, degrade, and so on.

In addition, there are cases where the carriage 31 decelerates immediately after the head 41 (the nozzle rows) have finished printing the image P (for example, see FIG. 6B, which will be described later). In such a case, the pre-irradiation unit 51 located on the opposite side as the side toward which the carriage 31 is moving is still opposed to the image P immediately after the carriage 31 begins decelerating. In other words, the end of the image P opposes the pre-irradiation unit 51 during the deceleration period, and the time for which the end of the image P and the pre-irradiation unit 51 are opposed increases. Although the quality of an image P printed using UV ink will not necessarily degrade simply because the image P is opposed to the pre-irradiation units 51 for a long period of time, there are cases where discoloration occurs, depending on the type of the UV ink. Accordingly, depending on the type of the UV ink, the quality of the image P will drop if the ends of the image P are opposed to the pre-irradiation units 51 during the deceleration period.

On the other hand, with the printer according to the comparative example shown in FIG. 4B, the carriage 31 moves at the constant velocity Vcc across the medium S in order to prevent an increase in the time for which the medium S and the image P oppose the pre-irradiation units 51. In other words, the carriage 31 moves across the medium S at the velocity Vcc, which is greater than the minimum velocity below which the pre-irradiation units 51 have negative influence on the medium S and the like. Accordingly, for example, the carriage 31 begins moving from a point to the left than the left end of the medium S that corresponds to the distance by which the carriage 31 moves during the acceleration period, and the carriage 31 is caused to decelerate after passing the right end of the medium S.

Doing so makes it possible to prevent the pre-irradiation units 51 from opposing the medium S and the image P during the acceleration/deceleration periods and stopped period of the carriage 31, which in turn makes it possible to prevent an increase in the time for which the medium S and the image P oppose the pre-irradiation units 51. Accordingly, it is possible to suppress the extension/shrinkage, degradation, and so on of the medium S, a drop in the quality of the image P, and so on caused by negative influence from the pre-irradiation units 51.

However, in this case, the carriage 31 moves significantly beyond the printing range of the image P, resulting in an increase in the distance that the carriage 31 moves unnecessarily, which in turn causes a wasteful increase in the printing time. The printing time is wastefully increased particularly in the case where the width of the image P is low compared to the width of the medium S.

First Working Example

Figure 5A:
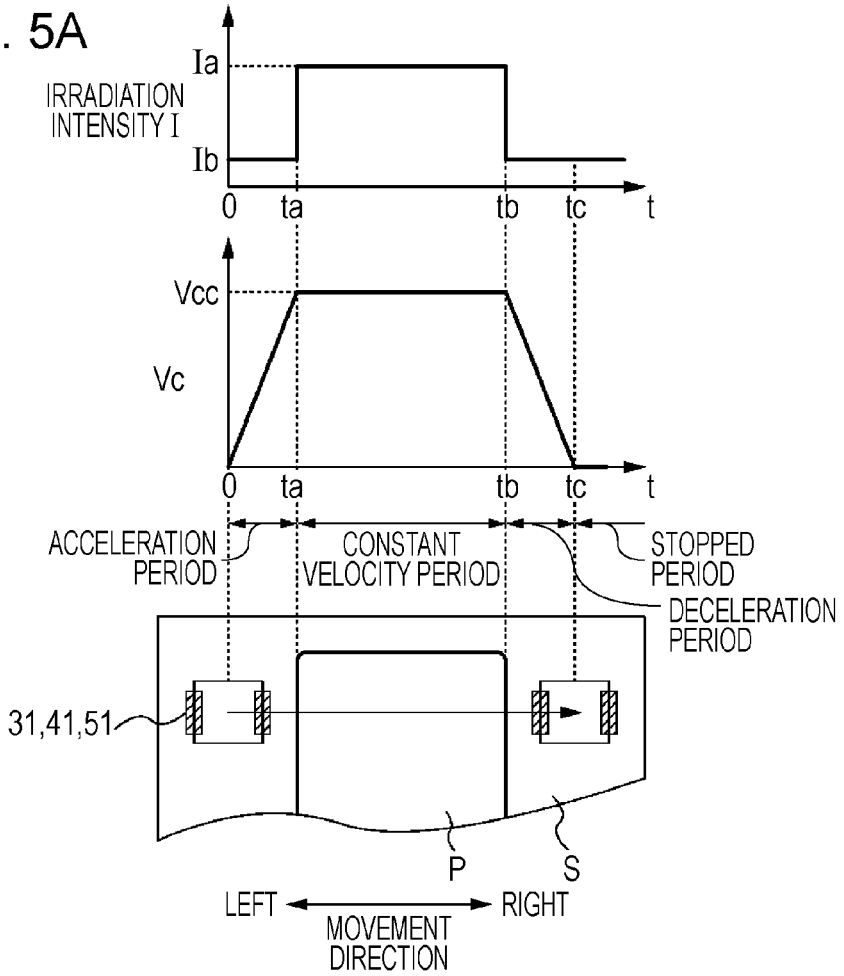

FIG. 5A is a diagram illustrating a relationship between an irradiation intensity I of the pre-irradiation units 51, the carriage velocity Vc, and the medium S and image P according to a first working example. The upper section of FIG. 5A is a graph illustrating a change in the irradiation intensity I of the pre-irradiation units 51 for time t, and the central section of FIG. 5A is a graph illustrating a change in the carriage velocity Vc for time t.

In the first working example, it is assumed that the image P is printed only during the constant velocity period and that the image P is not printed during the acceleration/deceleration periods. Furthermore, it is assumed that the two pre-irradiation units 51*a* and 51*b* are lighted continuously regardless of the direction in which the carriage 31 is moving, and that the irradiation intensity I changes in the same manner for both the pre-irradiation units 51*a* and 51*b*. However, the invention is not limited thereto, and the configuration may be such that only the first pre-irradiation unit 51*a* on the right side is lighted on the outbound pass (that is, during movement to the left) and only the second pre-irradiation unit 51*b* on the left side is lighted on the return pass (that is, during movement to the right).

Figure 5B:
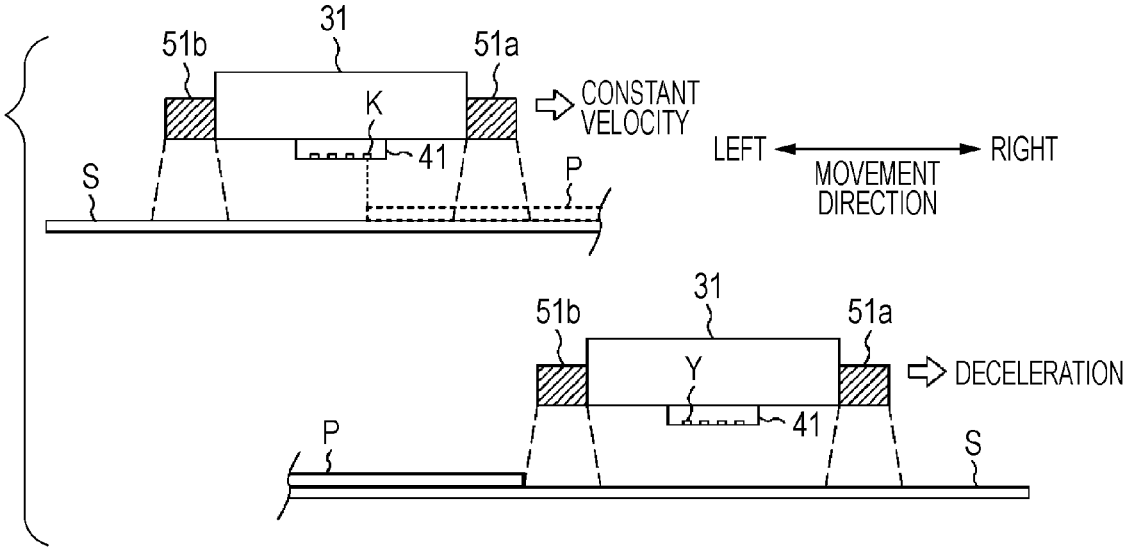
FIG. 5B is a diagram illustrating a starting position and an ending position of a constant velocity period.

FIG. 5B is a diagram illustrating a starting position and an ending position of the constant velocity period. In the first working example, the controller 10 of the printer 1 adjusts the movement distance of the carriage (that is, the head 41 and the pre-irradiation units 51) in the movement direction based on the positions of the ends, in the movement direction, of the image P that is printed onto the medium S. In other words, compared to a case where the width of the image P is a first width, the movement distance of the carriage 31 is shorter in the case where the width of the image P is a second width that is shorter than the first width.

For example, as shown in the upper section of FIG. 5B, during the return pass (that is, during movement to the right), a position where the black nozzle row K that is on the right end of the nozzle rows in the head 41 opposes the left end of the printing range of the image P is taken as the starting position for the constant velocity period. Then, as shown in the lower section of FIG. 5B, a position where the irradiation range of the second pre-irradiation unit 51*b* has passed the right end of the image P is taken as the ending position for the constant velocity period. Accordingly, the controller 10 starts the movement of the carriage 31 from a point that is shifted to the left from the starting position of the constant velocity period by an amount equivalent to the distance moved by the carriage 31 during the acceleration period, and stops the movement of the carriage 31 from a point that is shifted to the right from the ending position of the constant velocity period by an amount equivalent to the distance moved by the carriage 31 during the deceleration period.

In this manner, adjusting the movement distance of the carriage 31 in accordance with the width (that is, the length in the movement direction) of the image P makes it possible to shorten the movement distance of the carriage 31 and thus reduce the printing time. However, the pre-irradiation units 51 will oppose the medium S during the acceleration/deceleration periods. In other words, the medium is opposed to the pre-irradiation units 51 for a longer time in the areas where the medium is opposed to the pre-irradiation units 51 during the acceleration/deceleration periods than in the areas where the medium is opposed to the pre-irradiation units 51 during the constant velocity period.

Accordingly, in the first working example, as shown in the upper section of FIG. 5A, the controller 10 reduces the ultraviolet light irradiation intensity from an irradiation intensity Ia (mW/cm$^2$) for the pre-irradiation units 51 in the constant velocity period (ta to tb) to an irradiation intensity Ib (mW/

$cm^2$) for the pre-irradiation units 51 in the acceleration period (0 to ta) and the deceleration period (tb to tc).

Note that the controller 10 adjusts the irradiation intensity of the pre-irradiation units 51 by adjusting the current applied to the irradiation light sources (example: LEDs) of the pre-irradiation units 51. Increasing the current applied to the irradiation light source increases the irradiation intensity of the pre-irradiation units 51, whereas reducing the current applied to the irradiation light source reduces the irradiation intensity of the pre-irradiation units 51.

Furthermore, in the first working example, the irradiation intensity Ib in the acceleration period and the irradiation intensity Ib in the deceleration period are made equal, and the irradiation intensity Ib in the acceleration period and the irradiation intensity Ib in the deceleration period are constant. Accordingly, the controller 10 increases the irradiation intensity I of the pre-irradiation units 51 instantly when the acceleration period ends, and reduces the irradiation intensity I of the pre-irradiation units 51 instantly when the deceleration period begins.

By reducing the irradiation intensity of the pre-irradiation units 51, the amount of heat emitted from the pre-irradiation units 51 (irradiation light sources) toward the medium S per unit of time is reduced. Accordingly, in the first working example, the amount of heat emitted from the pre-irradiation units 51 toward the medium S per unit of time is lower in the acceleration/deceleration periods than in the constant velocity period. Therefore, according to the first working example, even if the time for which the medium S and the pre-irradiation units 51 are opposed increases during the acceleration/deceleration periods (that is, even if the time for which the medium S is irradiated with ultraviolet light by the pre-irradiation units 51 increases), the total amount of heat emitted toward the medium S from the pre-irradiation units 51 can be prevented from increasing during the acceleration/deceleration periods. Thus, according to the first working example, the area of the medium opposed to the pre-irradiation units 51 during the acceleration/deceleration periods can be prevented from extending/shrinking due to the heat from the pre-irradiation units 51.

Meanwhile, the amount of ultraviolet light irradiated by the pre-irradiation units 51 (that is, the irradiation energy (mJ/$cm^2$)) is determined by the product of the ultraviolet light irradiation intensity (mW/$cm^2$) and the irradiation time (s). Accordingly, reducing the irradiation intensity of the pre-irradiation units 51 during the acceleration/deceleration periods makes it possible to prevent an increase in the amount of ultraviolet light emitted from the pre-irradiation units 51 toward the medium S during the acceleration/deceleration periods, even if the time for which the medium S and the pre-irradiation units 51 are opposed to each other (that is, the irradiation time) increases during the acceleration/deceleration periods. Thus, according to the first working example, the area of the medium opposed to the pre-irradiation units 51 during the acceleration/deceleration periods can be prevented from degrading due to the ultraviolet light from the pre-irradiation units 51.

To summarize, according to the first working example, the controller 10 reduces the irradiation intensity for the irradiation intensity Ib of the pre-irradiation units 51 (light irradiation unit) during the acceleration/deceleration periods (that is, the acceleration period and the deceleration period), in which the velocity with which the carriage 31 moves the head 41 and the pre-irradiation units 51 is lower than the constant velocity Vcc, to a lower intensity than the irradiation intensity Ia of the pre-irradiation units 51 during the constant velocity period, in which the velocity with which the carriage 31 moves the head 41 and the pre-irradiation units 51 is the constant velocity Vcc (the predetermined velocity). The controller 10 then adjusts the amount by which the head 41 and the pre-irradiation units 51 are moved in the movement direction by the carriage 31 in accordance with the positions, in the movement direction, of the ends of the image P recorded onto the medium S.

By doing so, the movement distance of the carriage (the head 41 and the pre-irradiation units 51) can be reduced to the greatest extent possible in accordance with the size of the image P, which makes it possible to reduce the printing time and also makes it possible to prevent the pre-irradiation units 51 from negatively influencing the medium S (that is, extension/shrinkage due to heat, degradation due to ultraviolet light, and so on). In other words, a drop in the quality of the printed image can be prevented.

In addition, according to the first working example, the controller 10 sets the irradiation intensity Ib of the pre-irradiation units 51 in the stopped period of the carriage 31 (that is, the period spanning from when a deceleration period has ended to when the acceleration period of the next pass has begun) to be the same as the irradiation intensity Ib of the pre-irradiation units 51 in the acceleration/deceleration periods, and sets the irradiation intensity Ib to be lower than the irradiation intensity Ia of the pre-irradiation units 51 in the constant velocity period.

In the case where the width of the image P is shorter than the width of the medium S, the pre-irradiation units 51 will not pass the edge of the medium S during the deceleration period after the printing of the image P has ended, and the carriage 31 will stop in a state in which the pre-irradiation units 51 are opposed to the medium S. By doing so, the medium is opposed to the pre-irradiation units 51 for a longer time in the areas where the medium is opposed to the pre-irradiation units 51 during the stopped period than the areas where the medium is opposed to the pre-irradiation units 51 during the constant velocity period. However, according to the first working example, the irradiation intensity I of the pre-irradiation units 51 is reduced in the stopped period as compared to the constant velocity period, and thus the amount of heat, the amount of ultraviolet light, and so on emitted toward the medium S by the pre-irradiation units 51 can be prevented from increasing. Accordingly, the areas of the medium that oppose the pre-irradiation units 51 during the stopped period can be prevented from extending/shrinking, degrading, and so on.

Figure 6A:
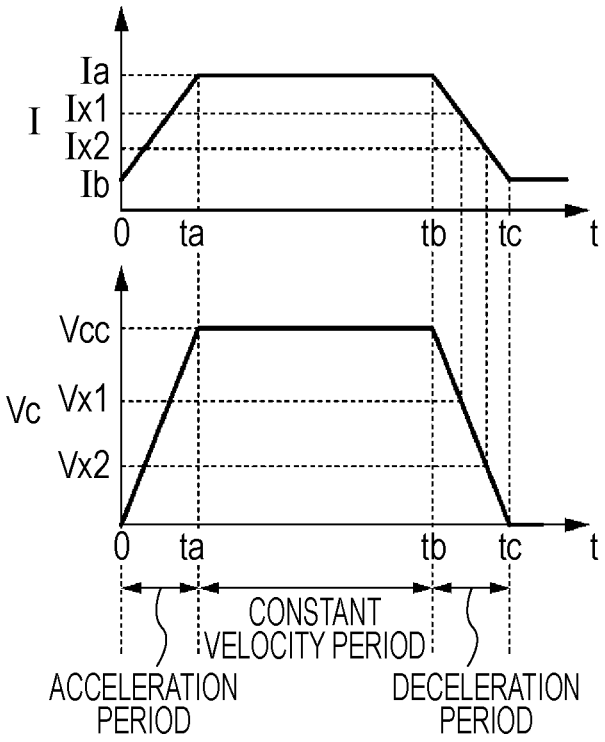
Figure 6B:
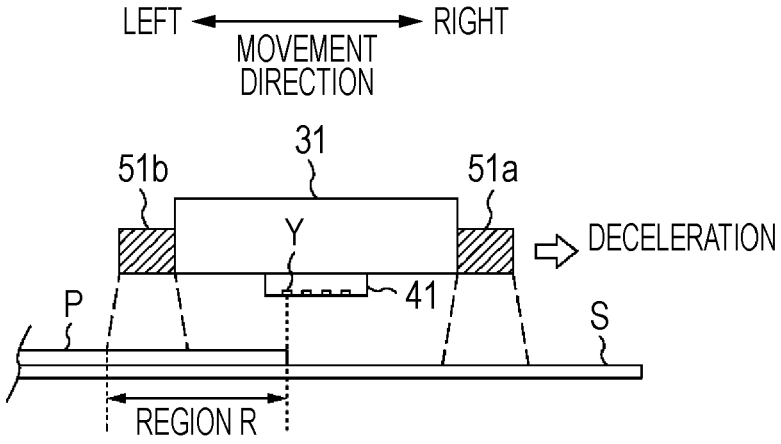
FIG. 6B is a diagram illustrating an ending position of a constant velocity period.

Furthermore, although it is described here that a point at which the irradiation range of the pre-irradiation units 51 has passed the end of the image P is taken as the ending position of the constant velocity period as shown in the lower section of FIG. 5B, the invention is not limited thereto, and a point at which the head 41 (nozzle rows) has passed the end of the image P may instead be taken as the ending position of the constant velocity period (for example, see FIG. 6B, which will be described later). In this case, the end of the image P opposes the pre-irradiation unit 51 during the deceleration period, and the time for which the end of the image P and the pre-irradiation unit 51 are opposed increases. In this case, depending on the type of the UV ink, there is a risk that the end of the image P will experience discoloration. However, according to the first working example, the irradiation intensity of the pre-irradiation units 51 is reduced during the deceleration period as compared to the constant velocity period, and it is thus possible to prevent an increase in the amount of ultraviolet light, amount of heat, and so on emitted from the pre-irradiation units 51 toward the image P during the deceleration period. Therefore, according to the first working example, it is possible to prevent the end of the image P that opposes the pre-irradiation unit 51 during the deceleration period from experiencing discoloration.

Second Working Example

FIG. 6A is a diagram illustrating a relationship between an irradiation intensity I of the pre-irradiation units 51 and the carriage velocity Vc according to a second working example. In the aforementioned first working example (FIG. 5A), the irradiation intensity Ib is constant in the acceleration period and the deceleration period regardless of the carriage velocity Vc.

As opposed to this, in the second working example, the controller 10 reduces the irradiation intensity in the acceleration/deceleration periods, from an irradiation intensity Ix1 for the pre-irradiation units 51 when the carriage velocity Vc (that is, the velocity at which the carriage 31 moves the head 41 and the pre-irradiation units 51) is a first velocity Vx1, to an irradiation intensity Ix2 for the pre-irradiation units 51 when the carriage velocity Vc is a second velocity Vx2 that is slower than the first velocity Vx1.

Here, the controller 10 gradually increases the irradiation intensity I of the pre-irradiation units 51 as the carriage velocity Vc gradually increases during the acceleration period, and gradually reduces the irradiation intensity I of the pre-irradiation units 51 as the carriage velocity Vc gradually decreases during the deceleration period. In other words, the controller 10 adjusts the irradiation intensity I of the pre-irradiation units 51 in accordance with the carriage velocity Vc.

FIG. 6B is a diagram illustrating an ending position of the constant velocity period. FIG. 6B illustrates the ending position of the constant velocity period during the return pass (when the carriage 31 is moving to the right). In the second working example, it is assumed that the controller 10 adjusts the movement distance of the carriage 31 in the movement direction in accordance with the positions, in the movement direction, of the ends of the image P, and that the image P is printed during the constant velocity period but is not printed during the acceleration/deceleration periods.

As shown in FIG. 6B, according to the second working example, a position where the yellow nozzle row Y that is on the left end of the nozzle rows in the head 41 opposes the right end of the image P is taken as the ending position for the constant velocity period. In this case, when the constant velocity period has ended, the second pre-irradiation unit 51*b* on the opposite side as the direction in which the carriage 31 moves still opposes the image P. In other words, a region R on the right end of the image P opposes the second pre-irradiation unit 51*b* and is cured immediately after the start of the deceleration period.

The time for which the medium S and the pre-irradiation units 51 are opposed is longer in the deceleration period than in the constant velocity period. However, the carriage velocity Vc has a lower deceleration, and the time for which the medium S and the pre-irradiation units 51 oppose is shorter, immediately after the deceleration period has started than immediately before the deceleration period has ended. Accordingly, if the irradiation intensity of the pre-irradiation units 51 is instantly reduced immediately after the deceleration period as in the first working example (FIG. 5A), a low amount of ultraviolet light will be irradiated by the second pre-irradiation unit 51*b* on the region R on the right side of the image P (that is, the irradiation energy) immediately after the start of the deceleration period, and there is thus the risk that the right side of the image P will be improperly cured.

Accordingly, as illustrated in the second working example (FIG. 6A), it is preferable for the irradiation intensity I of the pre-irradiation units 51 to be gradually reduced as the carriage velocity Vc gradually decreases during the deceleration period. By doing so, the irradiation intensity I of the pre-irradiation units 51 is comparatively high when the time for which the pre-irradiation units 51 and the image P oppose each other is comparatively short, immediately after the start of the deceleration period; this makes it possible to cure the ends of the image P as well with certainty.

Meanwhile, although the foregoing has described a case where the image P is printed only during the constant velocity period, the invention is not limited thereto. The image P may be printed during the acceleration/deceleration periods, in addition to the constant velocity period. In this case, the printable width of the image P can be increased.

Printing the image P in the acceleration/deceleration periods as well means that the pre-irradiation unit (example: second pre-irradiation unit 51*b*) provided on the opposite side as the direction in which the carriage 31 (example: to the right) cures the image P during the acceleration period and the deceleration period as well. The carriage velocity Vc is comparatively high, and thus the time for which the pre-irradiation units 51 and the image P are opposed is comparatively low, immediately after the end of the acceleration period and immediately after the start of the deceleration period. Accordingly, if the irradiation intensity of the pre-irradiation units 51 is kept low for the entirety of the acceleration period, the irradiation intensity of the pre-irradiation units 51 is instantly lowered immediately after the start of the deceleration period, or the like as in the first working example (FIG. 5A), the pre-irradiation units 51 will irradiate the image P with a low amount of ultraviolet light (irradiation energy) immediately before the end of the acceleration period, immediately after the start of the deceleration period, and so on, which leads to the risk that the ends of the image P will be improperly cured.

Accordingly, it is preferable, as described in the second working example (FIG. 6A), to adjust the irradiation intensity I of the pre-irradiation units 51 in accordance with the carriage velocity Vc during the acceleration/deceleration periods. By doing so, the irradiation intensity I of the pre-irradiation units 51 is comparatively high when the time for which the pre-irradiation units 51 and the image P oppose each other is comparatively low, immediately before the end of the acceleration period, immediately after the start of the deceleration period, and so on; this makes it possible to cure the image P with certainty.

Third Working Example

Figure 7:
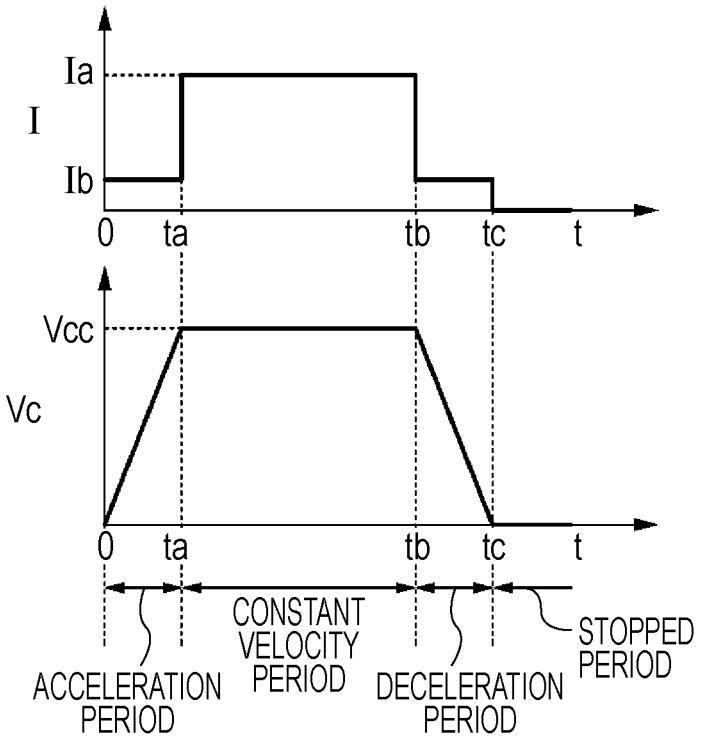
FIG. 7 is a diagram illustrating a relationship between an irradiation intensity of a pre-irradiation unit and a carriage velocity according to a third working example.

FIG. 7 is a diagram illustrating a relationship between an irradiation intensity I of the pre-irradiation units 51 and the carriage velocity Vc according to a third working example. There are situations where the carriage 31 stops in a state in which the pre-irradiation units 51 and the medium S oppose each other, such as the case where the movement distance of the carriage 31 in the movement direction is adjusted in accordance with the positions, in the movement direction, of the image P, the case where the image P is printed during the acceleration/deceleration periods in addition to the constant velocity period, and so on. During the stopped period for the carriage 31, the pre-irradiation units 51 and the medium S are opposed for an even longer amount of time than in the acceleration/deceleration periods. Therefore, it is easier for the medium S to extend/shrink, degrade, and so on due to negative influence from the pre-irradiation units 51 during the stopped period for the carriage 31.

Accordingly, in the third working example, the controller 10 stops the irradiation of ultraviolet light from the pre-irradiation units 51 during the period in which the carriage 31 stops moving the head 41 and the pre-irradiation units 51 in the movement direction while the pre-irradiation units 51 and the medium S are in an opposed state. In other words, as shown in FIG. 7, during the stopped period for the carriage 31 (from tc on), the controller 10 sets the irradiation intensity I of the pre-irradiation units 51 to zero.

By doing so, even if the medium S and the pre-irradiation units 51 are opposed to each other for a long time during the stopped period for the carriage 31, no heat, ultraviolet light, or the like is emitted from the pre-irradiation units 51 toward the medium S during the stopped period for the carriage 31, which makes it possible to prevent the extension/shrinkage, degradation, and so on of the medium S with even more certainty.

Fourth Working Example

Figure 8:
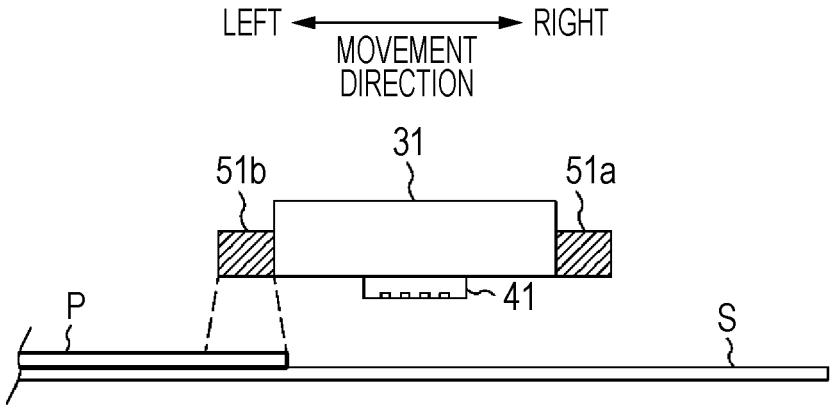
FIG. 8 is a diagram illustrating a stopped period for a carriage according to a fourth working example.

FIG. 8 is a diagram illustrating a stopped period for the carriage 31 according to a fourth working example. Normally, the image P will not degrade (for example, there will be no discoloration) even if the image P printed using UV ink and the pre-irradiation units 51 are opposed to each other for a long period of time (in other words, even if the image P is irradiated with ultraviolet light by the pre-irradiation units 51 for a long period of time). In other words, when opposed to the pre-irradiation units 51 for a long period of time (that is, when irradiated with ultraviolet light for a long period of time), it is less likely for the image P printed using UV ink to experience negative influence than it is for the medium S.

Accordingly, as shown in FIG. 8, in the fourth working example, the controller 10 stops the carriage 31 from moving the head 41 and the pre-irradiation units 51 in the movement direction when the ultraviolet light irradiation surfaces of the pre-irradiation units 51 are opposed to the UV ink (that is, the image P printed using UV ink) upon the medium S. Specifically, the controller 10 stops the movement of the carriage 31 when the irradiation range of the pre-irradiation unit 51 located on the opposite side as the direction in which the carriage 31 is moving the head 41 (in FIG. 8, the second pre-irradiation unit 51*b*) is positioned above the image P (that is, when the irradiation range is positioned on the inner sides of the image P). Note that in FIG. 8, the entire range of the lower surface of the second pre-irradiation unit 51*b* corresponds to the ultraviolet light irradiation surface of the pre-irradiation unit 51.

By doing so, the pre-irradiation unit 51 located on the opposite side as the direction in which the carriage 31 moves (in FIG. 8, the second pre-irradiation unit 51*b*) is not opposed to the medium S during the stopped period of the carriage 31, and thus the extension/shrinkage, degradation, and so on of the medium S due to negative influence from the pre-irradiation units 51 can be prevented with more certainty. Meanwhile, because the image quality of an image P printed using UV ink normally does not degrade even if the image P is opposed to the pre-irradiation units 51 for a long period of time, there is no problem even if the pre-irradiation unit 51 located on the opposite side as the direction in which the carriage 31 moves is opposed to the image P during the stopped period for the carriage 31. In other words, a degradation in the quality of the image P can be suppressed while also suppressing negative influence on the medium S by the pre-irradiation units 51.

It should be noted that during the stopped period for the carriage 31, the irradiation intensity I of the pre-irradiation unit located on the opposite side as the direction in which the carriage 31 moves (in FIG. 8, the second pre-irradiation unit 51*b*) may be the same as the irradiation intensity Ib during the acceleration/deceleration periods, and may be the same as the irradiation intensity Ia during the constant velocity period.

In addition, in the printer 1 according to the present embodiment, the pre-irradiation units 51 are provided on both sides of the head 41 in the movement direction, and the pre-irradiation unit located on the side to which the carriage 31 moves (in FIG. 8, the first pre-irradiation unit 51*a*) is opposed to the medium S during the stopped period for the carriage 31. Accordingly, during the stopped period for the carriage 31, it is preferable to set the irradiation intensity I of the pre-irradiation unit 51 located on the side to which the carriage 31 moves to the lower irradiation intensity Ib as during the acceleration/deceleration periods, to zero (that is, stopping the irradiation of ultraviolet light), or the like.

Meanwhile, the configuration is such that the one of the pre-irradiation units 51 located on the opposite side as the direction in which the carriage 31 is moving does not pass the end of the image P during the deceleration period, and the carriage 31 stops in a state in which the one of the pre-irradiation units 51 opposes the image P. Accordingly, the image P may be printed during the deceleration period as well, and the reduction in the carriage velocity Vc may be adjusted in accordance with the distance from the head 41 (nozzle row) to the one of the pre-irradiation units 51.

Fifth Working Example

Thus far, descriptions have been given in which the controller 10 adjusts the distance that the carriage 31 (the head 41 and the pre-irradiation units 51) moves in the movement direction in accordance with the locations of the ends, in the movement direction, of the image P (that is, in accordance with the width of the image P), but the invention is not limited thereto. The image P may be printed with the carriage 31 moving from the left end of the guide rail 32 to the right end of the guide rail 32 (the home position) in each pass, regardless of the width of the image P.

Even in this case, if the medium S is of a large size, the pre-irradiation units 51 will oppose the ends of the medium S during the acceleration/deceleration periods for the carriage 31. In other words, the medium is opposed to the pre-irradiation units 51 for a longer time at the ends of the medium S than at the areas where the medium is opposed to the pre-irradiation units 51 during the constant velocity period.

Accordingly, it is preferable to use a lower irradiation intensity for the pre-irradiation units 51 during the acceleration/deceleration periods than the irradiation intensity of the pre-irradiation units 51 during the constant velocity period, even in the case where the movement distance of the carriage 31 is adjusted in accordance with the location of the ends, in the movement direction, of the image P. By doing so, even if the ends of the medium S are opposed to the pre-irradiation units 51 during the acceleration/deceleration periods, the amount of heat, ultraviolet light, or the like emitted from the pre-irradiation units 51 toward the medium S can be prevented from increasing, which makes it possible to prevent the medium S from extending/drinking, degrading, or the like. In other words, negative influence on the medium by the pre-irradiation units 51 can be suppressed.

Other Embodiments

Although the aforementioned embodiment has primarily described an image recording apparatus, an image recording method and so on also falls within the scope of this disclosure. In addition, the aforementioned embodiment has been provided to facilitate understanding of the invention and is not to be interpreted as limiting the invention in any way. Many variations and modifications can be made without departing from the essential spirit of the present invention, and thus equivalents to all such variations and modifications also fall within the scope of the present invention.

Ink

Although the aforementioned embodiment describes ultraviolet light-curable ink (UV ink) as an example of the light-curable ink, the invention is not limited thereto. For example, an ink that is cured through irradiation with visible light may be employed as well.

Printer

Although the aforementioned embodiment describes a printer that repeatedly alternates between ejecting operations, in which ink is ejected from a head that moves in a movement direction, and transport operations, in which a medium is transported in a transport direction, the invention is not limited thereto. For example, the printer may be a printer that forms images on a continuous sheet of paper (or a single sheet of paper) transported into a printing region by repeatedly alternating between operations for forming an image while moving a head in a medium transport direction and operations for moving the head in a paper width direction, and then transporting a portion of the medium that has not yet been printed on into the printing region.

In addition, although the printer according to the aforementioned embodiment (FIG. 2B) is provided with the pre-irradiation units 51 on both sides of the head 41 in the movement direction and therefore prints images on both the outbound pass and the return pass, the invention is not limited thereto. For example, the printer may be configured so that a pre-irradiation unit 51 is provided only on one side of the head 41 in the movement direction and images are printed only when the carriage 31 moves toward the other side in the movement direction.

What is claimed is:

1. An image recording apparatus comprising:

a head that ejects light-curable ink onto a medium;

a light irradiation unit that cures the light-curable ink on the medium by irradiating the light-curable ink with light;

a movement mechanism that moves the head and the light irradiation unit in a predetermined direction relative to the medium; and a control unit that causes the repeated alternating execution of an ejection operation, in which the light-curable ink is ejected from the head while the head and the light irradiation unit are moved in the predetermined direction by the movement mechanism, and a transport operation, in which the medium is moved relative to the head and the light irradiation unit in a direction that is orthogonal to the predetermined direction, wherein the control unit reduces the irradiation intensity of the light irradiation unit during acceleration/deceleration periods, in which the movement mechanism moves the head and the light irradiation unit at a movement velocity that is slower than a predetermined velocity, to be lower than the irradiation intensity of the light irradiation unit during a constant velocity period, in which the movement mechanism moves the head and the light irradiation unit at the predetermined velocity, wherein a starting position of the constant velocity period is defined by a first edge of an image created by the ejected light-curable ink on the medium and an ending position of the constant velocity period is defined by a second edge of the image, wherein during the acceleration/deceleration periods, the movement mechanism moves the head and the light irradiation unit above an edge portion of the medium in the predetermined direction.

2. The image recording apparatus according to claim 1, wherein the control unit adjusts the amount the movement mechanism moves the head and the light irradiation unit in the predetermined direction in accordance with the location, in the predetermined direction, of an end of an image recorded on the medium.

3. The image recording apparatus according to claim 2, wherein the control unit stops the irradiation of light from the light irradiation unit during a period in which the movement of the head and the light irradiation unit in the predetermined direction by the movement mechanism is stopped in a state in which the light irradiation unit and the medium are opposed to each other.

4. The image recording apparatus according to claim 2, wherein the control unit stops the movement of the head and the light irradiation unit in the predetermined direction by the movement mechanism in a state in which the light irradiation surface of the light irradiation unit is opposed to the light-curable ink on the medium.

5. The image recording apparatus according to claim 1, wherein during the acceleration/deceleration periods, the control unit reduces the irradiation intensity of the light irradiation unit when the movement mechanism moves the head and the light irradiation unit at a second velocity that is slower than a first velocity, to be lower than the irradiation intensity of the light irradiation unit when the movement mechanism moves the head and the light irradiation unit at the first velocity.

6. An image recording method for recording an image onto a medium using an image recording apparatus, the apparatus including:

a head that ejects light-curable ink onto a medium;

a light irradiation unit that cures the light-curable ink on the medium by irradiating the light-curable ink with light;

a movement mechanism that moves the head and the light irradiation unit in a predetermined direction relative to the medium; and a control unit that causes the repeated alternating execution of an ejection operation, in which the light-curable ink is ejected from the head while the head and the light irradiation unit are moved in the predetermined direction by the movement mechanism, and a transport operation, in which the medium is moved relative to the head and the light irradiation unit in a direction that is orthogonal to the predetermined direction, wherein the control unit reduces the irradiation intensity of the light irradiation unit during acceleration/deceleration periods, in which the movement mechanism moves the head and the light irradiation unit at a movement velocity that is slower than a predetermined velocity, to be lower than the irradiation intensity of the light irradiation unit during a constant velocity period, in which the movement mechanism moves the head and the light irradiation unit at the predetermined velocity, wherein a starting position of the constant velocity period is defined by a first edge of an image created by the ejected light-curable ink on the medium and an ending position of the constant velocity period is defined by a second edge of the image, wherein during the acceleration/deceleration periods, the movement mechanism moves the head and the light irradiation unit above an edge portion of the medium in the predetermined direction.

* * * * *